US005682907A

United States Patent [19]

Conrad et al.

[11] Patent Number: 5,682,907

[45] Date of Patent: Nov. 4, 1997

[54] TOBACCO EXPANSION APPARATUS

[75] Inventors: Lucas Jones Conrad, Winston-Salem; Jackie Lee White, Pfafftown, both of N.C.

[73] Assignee: R. J. Reynolds Tobacco Company, Winston-Salem, N.C.

[21] Appl. No.: 546,473

[22] Filed: Oct. 19, 1995

Related U.S. Application Data

[62] Division of Ser. No. 76,535, Jun. 14, 1993, Pat. No. 5,483,977.

[51] Int. Cl.[6] ..... A24B 3/18

[52] U.S. Cl. ..... 131/291; 99/323.4

[58] Field of Search ..... 131/291, 296, 131/900–903; 99/323.4; 422/242, 292; 426/447, 449, 450; 49/477.1; 285/80, 95, 101, 104, 109; 92/165 R

[56] References Cited

U.S. PATENT DOCUMENTS

| | | |
|---|---|---|
| 4,165,012 | 8/1979 | Markwood . |
| 4,235,250 | 11/1980 | Utsch . |
| 4,258,729 | 3/1981 | de la Burde et al. . |
| 4,289,148 | 9/1981 | Ziehn . |
| 4,336,814 | 6/1982 | Sykes et al. . |
| 4,388,932 | 6/1983 | Merritt et al. . |
| 4,461,310 | 7/1984 | Ziehn . |
| 4,531,529 | 7/1985 | White et al. . |
| 4,554,932 | 11/1985 | Conrad et al. . |
| 4,561,453 | 12/1985 | Rothchild . |
| 4,962,773 | 10/1990 | White et al. . |
| 5,012,826 | 5/1991 | Kramer . |
| 5,031,644 | 7/1991 | Kramer . |
| 5,065,774 | 11/1991 | Grubbs et al. . |
| 5,095,923 | 3/1992 | Kramer . |

FOREIGN PATENT DOCUMENTS 602 944 A2 6/1994 European Pat. Off. .

OTHER PUBLICATIONS

"Breathing New Life Into Tobacco Expansion"; *Tobacco International*, Mar. 1, 1993.

*Primary Examiner*—Jennifer Bahr

[57] ABSTRACT

An apparatus for expanding tobacco includes a chamber having a spool and shell arrangement and a device for compressing tobacco into the shell for impregnation. The spool includes first and second cylindrical end members and a connecting rod between the first and second end members. A seal is provided between the outer surface of the end members and the shell. Expansion agent is introduced into the chamber to impregnate the tobacco for expansion.

17 Claims, 4 Drawing Sheets

TOBACCO EXPANSION APPARATUS

RELATED APPLICATIONS

This application is a divisional of application Ser. No 08/076,535 filed Jun. 14, 1993, now U.S. Pat. No. 5,483,977.

Field of the Invention

The invention relates to processes and apparatus for expanding tobacco. More particularly, the invention relates to processes and apparatus for improving throughput and economics of tobacco expansion.

BACKGROUND OF THE INVENTION

In the past two decades, tobacco expansion processes have become an important part of the cigarette manufacturing process. Tobacco expansion processes are used to restore tobacco bulk density and/or volume which are lost during curing and storage of tobacco leaf. In addition, expanded tobacco is an important component of many low tar and ultra-low tar cigarettes.

Commercially significant tobacco expansion processes are described in U.S. Pat. No. 3,524,451 to Fredrickson and U.S. Pat. No. 3,524,452 to Moser et al. These patents describe processes in which tobacco is contacted with an impregnant and then heated rapidly to volatilize the impregnant and expand the tobacco. A variation of these processes is described in U.S. Pat. No. 3,683,937 to Fredrickson et al. which discloses a tobacco expansion process employing an organic compound in the vapor state for impregnating tobacco. The impregnated tobacco is expanded either by heating or rapidly reducing pressure.

The use of a carbon dioxide for expanding tobacco is disclosed in U.S. Pat. No. 4,235,250 to Utsch; U.S. Pat. No. 4,258,729 to Burde et al.; and U.S. Pat. No. 4,336,814 to Sykes et al., among others. In these and related processes, carbon dioxide, either in gas or liquid form, is contacted with tobacco for impregnation and thereafter the impregnated tobacco is subjected to rapid heating conditions to volatilize the carbon dioxide and thereby expand the tobacco. In the known carbon dioxide expansion processes, it is typically necessary to heat the tobacco excessively in order to achieve substantial and stable expansion of the tobacco. This excessive heating can harm the tobacco flavor and/or generate an excessive amount of tobacco fines. In addition, those processes which use liquid carbon dioxide for impregnating tobacco typically result in impregnated tobacco in the form of solid blocks of tobacco containing dry ice, which must be broken up prior to heat treatment, thereby increasing the complexity of the process.

U.S. Pat. No. 4,461,310 to Zeihn and U.S. Pat. No. 4,289,148 to Zeihn describe the expansion of tobacco employing supercritical nitrogen or argon impregnation of tobacco. These gases are removed from the tobacco during a rapid pressure reduction, and the tobacco is expanded by exposure to heated gas or microwave. These processes require treatment of tobacco at pressures in excess of 2,000 or 4,000 psi up to above 10,000 psi in order to achieve substantial tobacco expansion.

U.S. Pat. No. 4,531,529 to White and Conrad describes a process for increasing the filling capacity of tobacco, wherein the tobacco is impregnated with a low-boiling and highly volatile expansion agent, such as a normally gaseous halocarbon or hydrocarbon at process conditions above or near the critical pressure and temperature of the expansion agent. The pressure is quickly released to the atmosphere so that the tobacco expands without the necessity of a heating step to either expand the tobacco or fix the tobacco in the expanded condition. The pressure conditions of this process range from 36 $Kg/cm^2$ (512 psi) and higher with no known upper limit. Pressures below 142 $Kg/cm^2$ (2,000 psi) were used to produce satisfactory tobacco expansion without excessive fracturing. Pressures above this range were said to normally not be needed. When the time period used to increase the expansion agent pressure to the necessary pressure ranged from 1 to 10 minutes, little or no additional holding time under pressure was needed in order to achieve effective impregnation of the tobacco.

U.S. Pat. No. 4,554,932 to Conrad and White describes a fluid pressure treating apparatus, including a cylindrical tubular shell and a reciprocal spool assembly mounted for movement between a loading position outside the shell and a treating position within the shell. Sealing members on the spool assembly are provided for engaging the shell to form a pressure chamber. Conduits are provided to introduce processing fluids into the pressure chamber. This system thereby provided an apparatus for use in high pressure materials treatment, such as tobacco impregnation for expansion, permitting easy loading and unloading and minimizing or eliminating problems associated with sealing and locking mechanisms normally used in high pressure treatment apparatus. Accordingly, this apparatus provided a pressure vessel producing time savings and improving economics in tobacco expansion.

U.S. Pat. No. 5,067,293 to Kramer is directed to a process and apparatus for the treatment of tobacco material and other biological materials having a mechanism for forming a dynamic seal in which cooperating moving surfaces seal a treatment chamber. The dynamic seal system provided according to this patent is useful in treating tobacco at elevated temperature and pressure conditions, including conditions of supercritical temperature and pressure for processes including tobacco expansion. Both continual and batch processes are disclosed. For tobacco expansion the use of supercritical fluids at weight ratios relative to the tobacco, of greater than 40:1 is disclosed, and complete impregnation of the tobacco material was said to be virtually instantaneous. Greater tobacco expansion was said to be obtained when impregnation times of 1 to 10 minutes were maintained prior to depressurization.

U.S. Pat. No. 4,962,773 to White et al. describes a process for subjecting a cigarette rod to conditions such that the cut filler undergoes volume expansion while within the paper wrap. The use of various impregnation conditions and fluids is described in this patent, including the use of impregnation conditions conducted above supercritical pressure and temperature. A pressure vessel having a volume of 4.5 liters was employed in the working examples to impregnate the tobacco rods under supercritical conditions.

Tobacco expansion processes including those described above and others, must be conducted in a batch process or continual process (Kramer U.S. Pat. No. 5,067,293) when impregnation pressures substantially above atmospheric pressure are used. The batch and continual treating processes require complicated treating apparatus and increased cycle times because of the time required in opening and closing the vessels and introducing and removing impregnating agent from the vessels. Some throughput improvements have been made by modifying the various apparatus employed to decrease cycle time; however, substantial throughput improvements in the known batch systems are available according to conventional techniques primarily by increasing volumes of the individual systems and/or increasing the number of batch systems used simultaneously.

SUMMARY OF THE INVENTION

This invention provides improvements in tobacco expansion processes which are capable of dramatically improving tobacco throughput in high pressure tobacco impregnation systems. In accordance with various aspects of the invention, tobacco can be impregnated in a high pressure impregnation zone and removed from the zone for expansion in complete cycle times of less than one minute, typically less than about 15–30 seconds. In addition, tobacco throughputs are further improved in accordance with other aspects of the invention by achieving dramatically improved use of the available treatment space in a high pressure impregnation zone. In addition, the invention provides processes for minimizing the amount of expansion agent used to treat tobacco.

In one aspect, the invention provides a high pressure tobacco impregnation process wherein substantially the entire available impregnation space in a high pressure impregnation zone is filled with compressed tobacco. An agent is admitted into the impregnation zone and impregnates the compressed tobacco. Typically the compressed tobacco, is compressed in an amount of greater than 1.25:1, for example, 1.5:1, and is preferably compressed in an amount of at least 2:1–3:1 or greater. Thus, the throughput for the available space in the impregnation zone is greatly improved, e.g. by 50% to 200% or more. Despite the compression of the tobacco during impregnation, substantial tobacco expansion of at least 50%, up to and greater than 100% increase in filling capacity can be achieved in preferred embodiments. Moreover, in preferred embodiments of the invention, cycle times of less than 20 seconds can be employed for impregnating the compressed tobacco.

In addition to dramatically improving available throughput for a high pressure treating vessel, this aspect of the invention can also provide a substantial decrease in the amount of expansion agent admitted to the impregnation zone during impregnation. This aspect of the invention thus provides a tobacco expansion process wherein the volume of expansion agent used to impregnate tobacco can be less than the volume of the tobacco when measured in loose, i.e. non-compacted, form. Typically, the volume of expansion agent can be about one-half or less compared to the tobacco volume.

In another aspect of the invention, the cycle time for impregnating tobacco under conditions near or above conditions of supercritical pressure and temperature is significantly improved by preheating the tobacco prior to introducing the tobacco into the impregnation zone. In yet another aspect of the invention, it has been found that prepressurizing and preheating expansion agent to temperature and pressure conditions above supercritical values prior to admission into the impregnation zone, allows for successful tobacco impregnation with expansion agent in a matter of seconds to provide impregnated tobacco capable of substantial expansion. Complete cycle times, including supercritical fluid introduction time, impregnation time and pressure release time, of less than one minute, preferably less than 20 seconds, can be achieved in accordance with this aspect of the invention. Filling capacity increases greater than 50%, up to and exceeding 100% can be achieved at cycle times of 10–12 seconds or lower.

Various apparatus can be employed in conducting the processes of the invention. In one preferred embodiment, a spool-type tobacco expansion apparatus of the type disclosed in U.S. Pat. No. 4,554,932 to Conrad and White is used. More preferably, this apparatus is modified to incorporate a preferred tobacco loading means which simultaneously loads and compresses tobacco into the movable spool.

In accordance with another apparatus embodiment of the invention, a gas/gas accumulator is used to provide preheated high pressure fluid to the tobacco expansion zone. The use of the gas/gas accumulator minimizes volume of stored high pressure, high temperature fluid during a high temperature, high pressure impregnation process, thereby minimizing needs for high pressure vessels and decreasing safety concerns associated with the process.

In greatly preferred embodiments of the invention, propane fluid is provided at a temperature above its critical temperature and above its critical pressure for impregnating the tobacco according to the process of White and Conrad, U.S. Pat. No. 4,531,529. It has now been found that use of propane at pressures above 2,000 psi reduces cycle time. By combining the various aspects of the present invention, tobacco throughput in a high pressure impregnation zone can be increased by factors in excess of 10–30 times of the throughputs described in the prior art. Thus, compressing the tobacco provides a throughput compared to normal throughput of two to three times or more. By employing preheated tobacco and/or substantially instantaneously introducing preheated, prepressurized supercritical fluid into the expansion zone, up to five or more cycles of tobacco impregnation can be completed for each minute of operation. Thus, an expansion chamber of a given volume can readily be used to impregnate loose tobacco volumes exceeding five, and preferably 10 to 15 or more times the impregnation chamber volume for each minute of operation.

BRIEF DESCRIPTION OF THE DRAWINGS

In the drawings which form a portion of the original disclosure of the invention.

DETAILED DESCRIPTION OF THE PREFERRED EMBODIMENT

Figure 1:
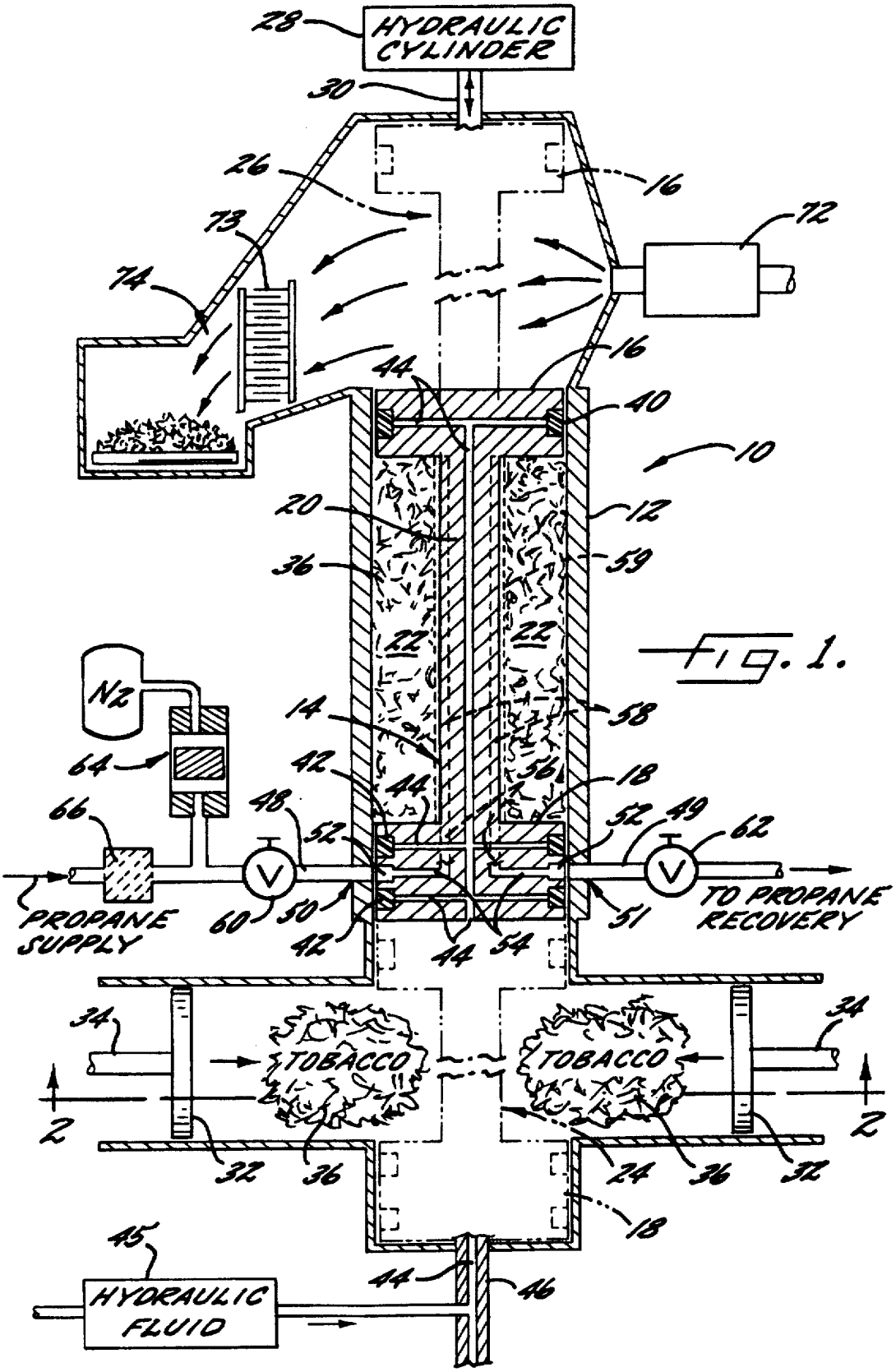
FIG. 1 is a schematic cross-sectional view of one preferred apparatus employed in the invention with various different operating positions being partially illustrated in phantom.

Different process and apparatus embodiments of the invention are set forth below. While the invention is described with reference to specific processes and apparatus including those illustrated in the drawings, it will be understood that the invention is not intended to be so limited. To the contrary, the invention includes numerous alternatives, modifications and equivalents as will become apparent from a consideration the foregoing discussion and the following detailed description.

FIG. 1 illustrates a preferred apparatus employed in various aspects of the invention. The apparatus of FIG. 1 is generally constructed in accordance with U.S. Pat. No. 4,554,932, issued Nov. 26, 1985 to Conrad and White, and which is hereby incorporated by reference. Various details disclosed in the '932 patent are not repeated herein for the sake of brevity. However, reference may be had to the '932 patent for such details.

As shown in FIG. 1, the apparatus includes a pressure vessel 10 including a cylindrical tubular shell or enclosure 12 and a spool assembly 14. The shell 12 and spool assembly 14 can be made of any suitable materials, including stainless steel, bronze and the like. The specific construction and size of the shell and spool will be sufficient to withstand the pressures contemplated within the pressure vessel as will be apparent.

The spool assembly 14 includes cylindrically shaped end members 16 and 18 and a connecting rod 20. When the spool is within the shell 12 as illustrated in FIG. 1, the end members 16 and 18, the connecting rod 20 and the shell 12 define an annular space 22 of predetermined volume constituting a sealed pressure chamber or zone.

As illustrated in FIG. 1, the spool assembly is positioned horizontally and is arranged for reciprocating movement between a loading position 24, illustrated in phantom, an unloading position 26, also illustrated in phantom, and the impregnating position specifically shown in FIG. 1. A hydraulic piston or similar motor means 28 is axially attached via a shaft 30 partially shown in FIG. 1 for moving the spool among the three positions.

Tobacco is loaded onto the spool in position 24 by means of a pair of opposed semi-cylindrical loading members 32. The tobacco can be in any of various forms including the form of leaf (including stem and veins), strips (leaf with the stem removed), or cigarette cut filler (strips cut or shredded for cigarette making). The loading members 32 are connected via rods 34 to a reciprocating force means, not shown, such as a hydraulic piston or the like. Separate charges of tobacco 36 are forced onto the spool 14, preferably to compress the tobacco as discussed in greater detail below in connection with FIG. 2.

Following loading of the spool at position 24, the spool is moved to the impregnating position. Each of the end members 16 and 18 include inflatable sealing members 40 and 42, respectively. The sealing members are formed of hydraulically inflatable elastomeric rings which receive a hydraulic fluid via fluid lines 44. Hydraulic fluid, such as food grade oil, is forced through the lines 44 by a hydraulic accumulator 45, and into the sealing members 40 causing same to expand outwardly and seal the pressure chamber 22 against leaks. The sealing members also advantageously include integral wear rings, not shown, which serve to scrape tobacco particles off of the inside surface of shell 12 and tobacco loading members 32 as the spool moves from position to position. Hydraulic fluid is introduced into line 44 from one end of the spool via a bore through a connecting rod 46, partially illustrated in FIG. 1 and which is connected to at least one end of the spool 14.

High pressure gas lines 48 and 49 communicate through the shell 12 via ports 50 and 51 which are aligned with an annular space 52 formed on end member 18 between sealing members 42. The annular space 52 is connected via a plurality of radial ports 54 and axial ports 56 with grooves 58 formed in the surface of connecting rod 20. The ports 50 and 51 thereby allow for the introduction and removal of high pressure fluid into and out of the pressure chamber 22 when the spool member 14 is in the position shown. One or more screens 59 surround the connecting rod 20 to prevent tobacco from clogging the ports 56 and grooves 58.

A pair of fast acting valves 60 and 62 are provided for rapid introduction and release of fluid into and out of the impregnating chamber 22. These valves are preferably ball valves having a port size ranging from ½ inch to 1.5 inch in diameter or greater depending on the size of the impregnation zone 22 to thereby provide for substantially instantaneous admittance and removal of high pressure fluid to and from the impregnation zone 22. The valves are advantageously automatically opened and closed by fast acting hydraulic actuators, not shown.

On the input side, the high pressure gas line 48 is connected to an accumulator device 64 discussed in greater detail below. A vaporizer 66 is provided for heating gas fed to the accumulator 64. Accumulator 64 may also be heated by means not shown to maintain the fluid within the accumulator in heated condition. A high pressure pump, not shown, is provided upstream of vaporizer 66 for feeding high pressure fluid at, e.g., 2,500 psig to vaporizer 66 and accumulator 64.

The high pressure line 49, which is used to remove high pressure fluid from the impregnation zone 22 is connected to a gas recovery zone (not shown) for recovery of fluid removed from the impregnation zone.

A pneumatic unloading device such as an oil free compressor 72 is provided in the tobacco unloading zone and directs fluid such as high pressure air or nitrogen onto the tobacco surrounding spool 14 when the spool is moved to and from the unloading position 26. Tobacco removed in unloading position 26 is received in a detangler unit 73 comprising intermeshing oscillating tines and is then fed to a recovery chute 74 wherein the tobacco may be further treated for drying, or heated for expansion, if desired.

Figure 2:
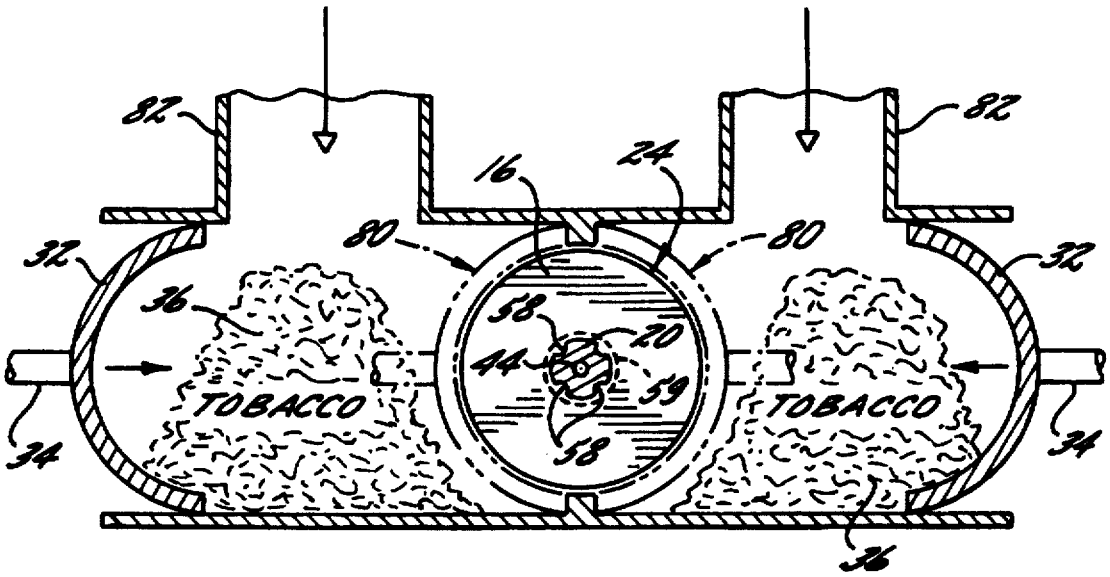
FIG. 2 is a schematic cross-sectional view taken along line 2—2 of FIG. 1 and illustrates a tobacco compacting apparatus for introducing compacted tobacco into the impregnation space of the apparatus illustrated in FIG. 1.

FIG. 2 schematically illustrates the tobacco compression loading means 32, which are used to compress tobacco around the spool 14. As shown, each of the loading members 32 are semi-cylindrical members mounted for movement between a withdrawn position and a closed position 80, illustrated in phantom. Tobacco 36 is fed via chutes 82 into the tobacco loading zone. The cylindrical members 32 are thereafter moved to loading position 80 to press the tobacco 36 onto the spool member 14, thereby substantially filling the annular space between the end members 16 and 18 and surrounding the connecting rod 20. The amount of tobacco 36 is preferably an amount such that its volume when measured in loose form, prior to loading onto the spool 14 is substantially greater than the volume of this annular space.

The tobacco volume prior to compression, or loose fill volume of the tobacco, is determined by measuring the tobacco density in a cubic container of one foot by one foot by one foot. Tobacco is poured into the cubic container and weighed to determine the loose fill density of the tobacco. The loose fill volume of a tobacco charge prior to compression onto the spool then can be determined from the weight of the charge and the loose fill density value of the tobacco. The loose fill volume of the charge is divided by the compressed volume of the tobacco charge, i.e., the volume on the spool, to determine compression ratio. All values are determined at, or corrected to, the actual moisture of the tobacco charge fed to the impregnation zone. Thus, for a spool having an impregnation volume of 25 cubic inches, compressing tobacco having a loose fill volume of 50 cubic inches onto the spool, would result in a compression ratio of 2:1.

It will be apparent that the volume available on spool 14 for occupation by tobacco will be less than the total space available for occupation by high pressure fluid. In this regard, the spool includes fluid ports 54 and 56 and channels 58 which constitute space available to the fluid but which cannot be occupied by tobacco due to the presence of the screen 59. Thus, the "available volume" for occupation by tobacco, i.e., the volume which available for occupation by tobacco tightly packed into impregnation zone 22, is typically less than the volume available for occupation by impregnation fluid. Typically, the available volume for occupation by tobacco is about 75–80% of the volume available to the impregnation fluid, the latter including the space defined by the various channels and ports, which is not available to the tobacco.

Figure 3:
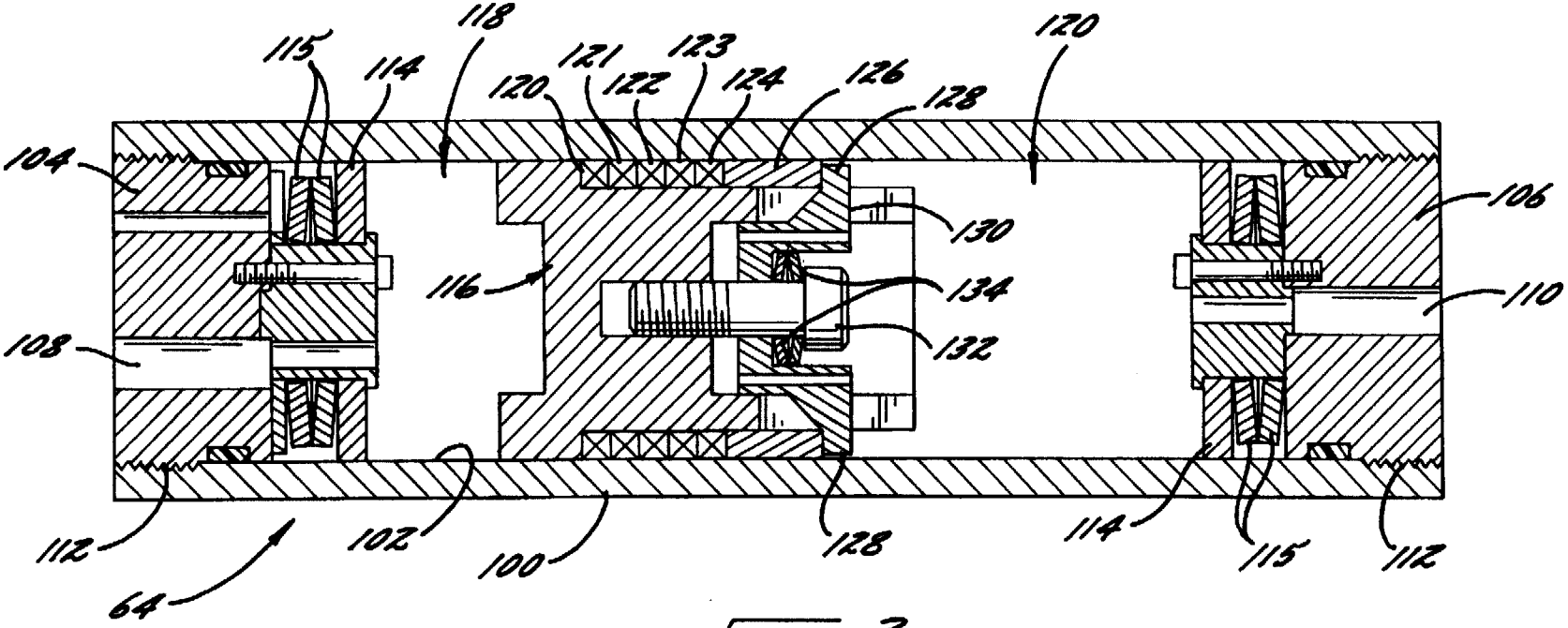
FIG. 3 is a cross-sectional view of one preferred gas/gas accumulator for use in the apparatus illustrated in FIG. 1, and which is capable of substantially instantaneous introduction of fluids having temperatures and pressures above the supercritical temperatures and pressures thereof into the apparatus of FIG. 1.

FIG. 3 illustrates a preferred gas/gas accumulating device which is useful in accordance with the invention. The accumulator 64 is used to provide a high pressure impregnation fluid, such as propane at 2,500 psig, to the impregnation zone in the spool impregnator shown in FIG. 1. The accumulator 64 includes a tubular shell 100 formed of a material capable of withstanding high temperatures and pressures, such as a high grade carbon steel and which has been hardened on its inside surface 102. At each end of the accumulator there are end members 104 and 106 including ports 108 and 110, respectively, for admitting high pressure gas. The end members are secured by threads 112 in the ends of the shell 100. Mounted on each end member is a shock absorbing device, including an annular member 114 supported by a pair of flange springs 115 in the form of Bellville washers.

A centrally located piston member 116 is mounted for movement within the cylinder 100 and defines two separate fluid zones 118 and 120 on the opposed sides thereof. The piston member 116 is prepared from a suitable material such as phosphor bronze. Five separate carbon packing rings 120–124 surround the periphery of the piston 116 and provide for sealing contact between the exterior periphery of the piston 116 and the interior of the shell 100. The three inside piston rings 121–123 are more flexible than the exterior piston rings 120 and 124. These packing rings are molded from GRAFOIL carbon and are commercially available from A.W. Chesterson Company as NS Style 5300 Solid Die Formed Rings (121–123) and NS Style 5600 GTP HD Solid Die Formed Rings (120, 124).

The packing rings 120–124 are maintained under compression by an annular ring member 126, which is forced axially against the rings by the ears 128 of an annular forcing member 130. The forcing member 130 is secured to the piston member 116 by a threaded bolt 132 and applies a predetermined biasing force due to biasing members 134 which are ¾ inch flange springs commercially available from A.W. Chesterson Company as Style 5500 ¾ inch Flange Springs. The compression force applied via bolt 132, compression member 130 and annular ring 126 to the packing rings 122–124 is the amount of force just sufficient to flatten the two flange springs 134 by tightening of the bolt 132. This results in an outward expansion of the packing rings 120 and 124, which thereby form a sealing force between the exterior periphery of the sliding piston 116 and the interior periphery of the shell 100.

An inert high pressure gas, such as nitrogen, at a pressure of 6,000 psig is maintained in one fluid chamber, 118, while impregnation fluid, such as propane, at 2,500 psig is maintained in the second fluid zone 120. When high pressure impregnation fluid is released from the zone 120 into the impregnator illustrated in FIG. 1, the piston 116 can be moved rapidly into contact with end member 112 and the force is absorbed by the force-absorbing members 114 and 116. Thereafter, impregnation fluid is pumped back into the accumulator until the predetermined pressure, preferably, 2,500 psi, is reached.

Returning to FIG. 1, in operation, a high pressure pump, not shown, is used to provide propane to the accumulator 64. When a gas is discharged from the accumulator, the pressure loss is sensed by means not shown and a control activates the pump which immediately starts refilling the accumulator with high pressure fluid, such as propane. The gas accumulator 64 can be refilled in a short period of 5–30 seconds, during the period employed in the present invention for impregnating the tobacco in impregnation zone 22 of FIG. 1.

Figure 4:
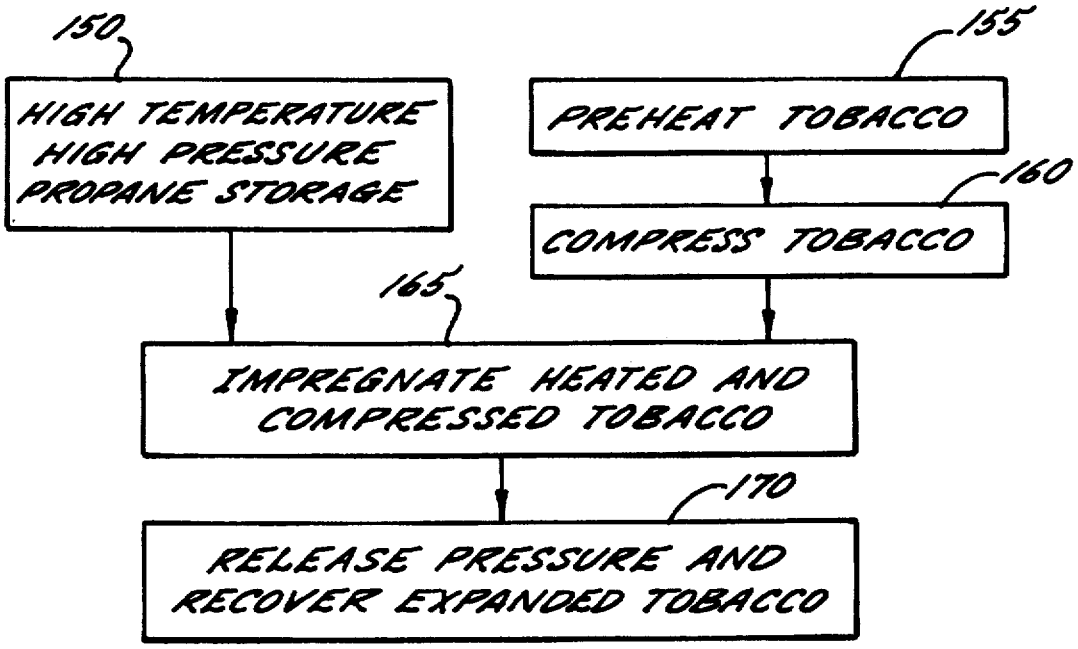
FIG. 4 illustrates a preferred process employing various aspects of the invention.

FIG. 4 illustrates one preferred process of the invention. Preferably the process of FIG. 4 is conducted in accordance with U.S. Pat. No. 4,531,529 issued Jul. 30, 1985 to White and Conrad, which is hereby incorporated by reference. A high pressure, high temperature propane storage unit, such as accumulator 64 of FIG. 3, is provided as shown in Block 150. The storage unit 150 can take forms other than accumulator 64. For example, a high volume surge tank is also contemplated for storage of high temperature, high pressure propane. Alternatively, a Metal Bellows accumulator available from Parker Bertea Aerospace, Parker Hannfin Corp., Metal Bellows Division, Moorpark, Calif., is contemplated for use herein.

The pressure of the propane is maintained preferably above 2,000 psi, advantageously between about 2,500 psi and 3,000 psi. In accordance with the present invention, it has been found that extremely short impregnation times, between about 5 and about 15 seconds, can be used to impregnate tobacco when these high pressures are used, while obtaining extremely desirable increases in tobacco filling capacity, for example, in excess of 50 to 100% increase in filling capacity. The temperature of the propane is advantageously maintained above 280° F., preferably between about 300° F. and 400° F., e.g., about 300°–315° F. This provides excess sensible heat for heating the tobacco in the impregnation zone.

As indicated in Block 155, tobacco preferably in the form of cut filler is advantageously preheated prior to introduction into the impregnation zone. Preheating of the tobacco also provides heat for establishing proper short cycle time conditions in the impregnation zone. Preferably, the tobacco is preheated to a temperature above about 125° F., more preferably a temperature of about 140° F. or greater e.g., to a temperature of 150°–160° F. or higher. Extra moisture can be added to the tobacco to increase the pliability of the tobacco. Moisture contents between about 16%, up to about 30% or more, are advantageously used in the invention.

Preheating of the tobacco can be conducted by any of various means including the use of heated drums, microwave energy and steam injection. Steam heating is believed to be preferable because heat is more effectively transferred to the tobacco, while at the same time the moisture level can be increased.

The preheated tobacco is thereafter compressed as indicated in Block 160. As discussed previously, the tobacco is preferably compressed at a compression ratio of at least about 1.25:1, more preferably above 1.5:1. Advantageously, the tobacco is compressed to a compression ratio of greater than 2:1, up to ratios amounts of 3:1 and greater. Compression of the tobacco increases the tobacco density so that the density of the tobacco fed into the impregnation zone is substantially greater than the tobacco density prior to compression. Those skilled in the art will be aware that loose fill tobacco densities can vary greatly depending on whether the tobacco is in leaf form or in cut filler form; the type of tobacco, the moisture content of the tobacco, and other factors. Packing densities of 20 pounds per cubic foot, calculated based on a moisture content of 12% are readily employed in the present invention. Although increasing the packing density can, to some extent, increase the cycle time for achieving identical amounts of expansion, packing densities in excess of 25–30 pounds per cubic foot calculated based on 12% moisture and higher have also been successfully used in the present invention while achieving impregnation times of below 20 seconds and filling capacity increases in excess of 50–100%.

The compressed tobacco is thereafter impregnated in the impregnation zone as indicated in Block 165. When propane is used as the impregnating fluid, the cumulative amount of heat supplied to the impregnation zone from the heated propane and the preheated tobacco is advantageously sufficient to provide impregnation conditions in the impregnation zone of between about 240° F. and about 270° F., preferably about 260° F. It has been found that impregnation at temperature and pressure conditions of about 260° F. and 2,500 psig can be achieved in about 5 seconds or even less when the heat is supplied by both the preheated tobacco and preheated propane.

It will be apparent that, when the propane fluid is heated to higher temperatures the tobacco can be heated to a lesser degree to provide the desirable temperature conditions in the impregnation zone. However, there is believed to be an upper limit of temperature for the propane above which the tobacco in the impregnation zone might be harmed. In addition, because low volumes of impregnation fluids are used in preferred embodiments of the present invention, the mass of the impregnation fluid available for heating of the tobacco is relatively low. The expansion agent mass is typically about the same or less than the mass of the tobacco. Thus, the addition of heat from a source such as the tobacco is desirable.

It will also be apparent that temperature conditions in the tobacco impregnation zone can be achieved by other means, such as by employing a heater in the impregnation zone. However, for extremely short cycle times, the combination of preheated tobacco and preheated high pressure propane has been found to produce extremely desirable results. The advantageous effects of preheating the tobacco are not fully understood. However, it is possible that preheated tobacco might absorb impregnation fluid at a faster rate than ambient temperature tobacco due to factors including pliability of the tobacco.

The compressed and impregnated tobacco is maintained under impregnation conditions for a short period of time ranging from 1–2 seconds up to about twenty seconds. As shown in Block 170 of FIG. 4, thereafter the pressure is released. Preferably, pressure release is substantially instantaneous, i.e., is achieved in about one second or less. This can be achieved by employing a fast acting valve having a large port for rapidly releasing pressure. The compressed tobacco is then substantially immediately removed from the impregnation zone so that expansion of the tobacco can be effected. Preferably, the tobacco is treated by contact with forced dry air or heated air in order to establish a moisture content of, for example, about 10–12% moisture which helps stabilize the tobacco in expanded form.

When the expansion agent is propane or a similar expansion agent of the type disclosed in U.S. Pat. No. 4,531,529 to the White and Conrad, no heating of the tobacco is necessary in order to fix the tobacco in expanded form. Moreover, there is no substantial loss of volatile flavoring agents, sugars or the like, because of the lack of high temperature heating conditions. However, the invention can also be employed in connection with other expansion agents including those which require the use of expansion conditions including heat in order to achieve or fix expansion of the tobacco.

Figure 5:
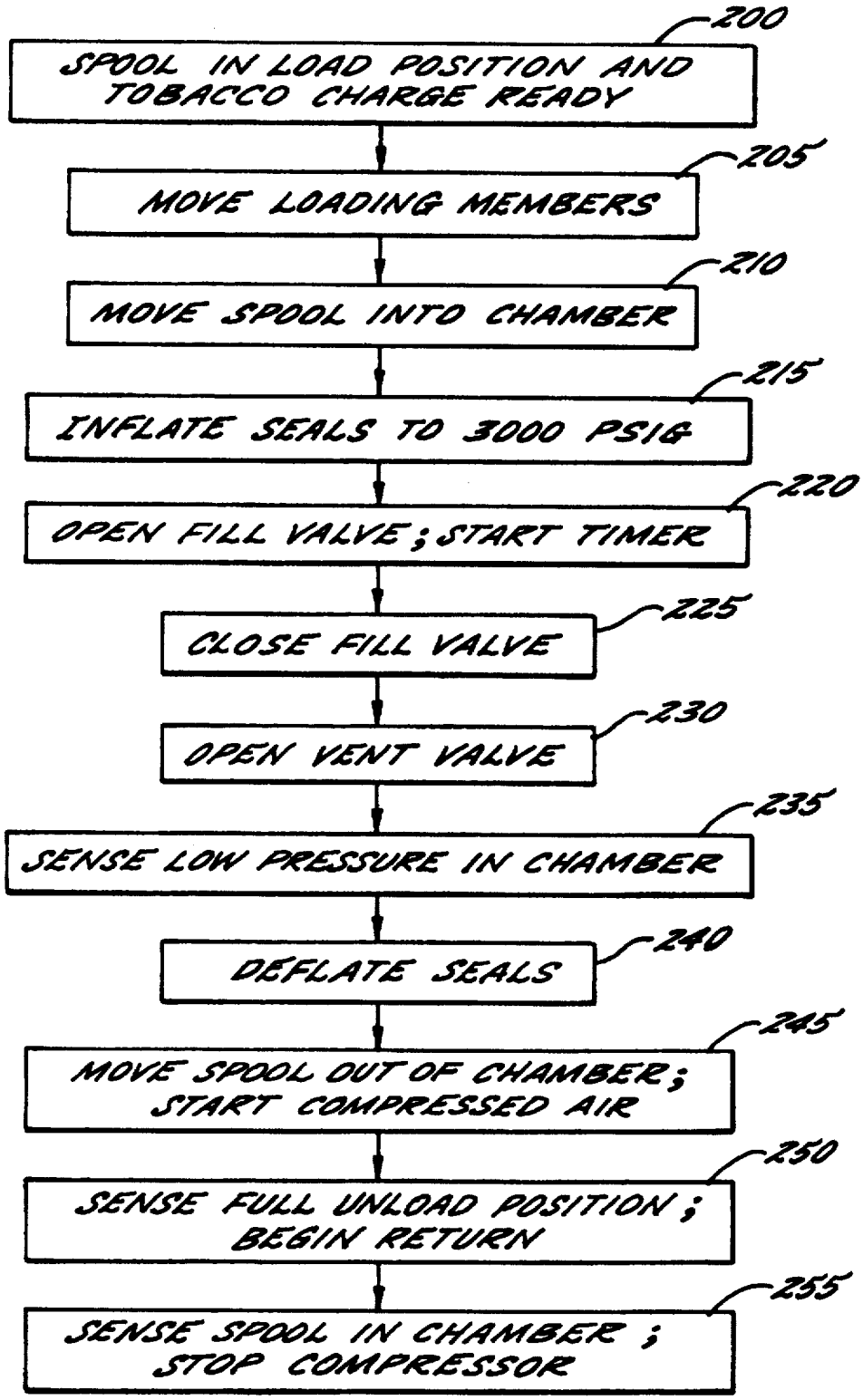
FIG. 5 schematically illustrates a preferred control method for operating the apparatus illustrated in FIG. 1.

FIG. 5 illustrates a control method used in connection with the apparatus of FIG. 1 to achieve substantial expansion of tobacco in short cycle times of less than twenty seconds. This or a similar control system including sensors for sensing conditions during the expansion process are extremely desirable in order to achieve cycle times of twenty seconds or less. Control hardware can be pneumatic, electric or pneumatic and electric based and can include a microprocessor as will be apparent to those skilled in the art.

With reference to FIG. 5, in Block 200 appropriate sensors are used to verify that the spool is in the loading position 24 and that an appropriately sized charge of tobacco is in position for loading. If these conditions are satisfied, control passes to Block 205 and the loading members 32 are moved to force tobacco onto the spool 14. An appropriate sensing mechanism such as a proof of position valve senses the presence of both loading members 32 in the appropriate loading position and control is then passed to Block 210. In Block 210, the hydraulic piston 28 is activated to move the spool into the pressure shell 12. An appropriate sensor such as a proof of position valve or the like senses the position of the spool in the proper location in shell 12 and control is then passed to Block 215.

In Block 215, a valve is opened to allow hydraulic fluid from hydraulic accumulator 45 to fill seals 40 and 42. The hydraulic accumulator 45 preferably holds sufficient amount of hydraulic fluid to pressurize each of seals 40 and 42 to a pressure of 3,000 psi during a time period of about one second or less, preferably substantially less than one second. An appropriate sensor senses the fluid pressure of fluid within the seals 40 and 42 and when the pressure is at the desired pressure, for example, 3,000 psi, control is passed to Block 220.

In Block 220, the fast acting fill valve 60 is opened and a timer is activated. This allows heated and pressurized impregnation fluid, such as propane at a pressure above 2,000 psig and a temperature of about 300° F. or greater to enter into the impregnation zone 22. Under these conditions, and particularly when the tobacco in the impregnation zone has been preheated, the impregnation is quite rapid so that the timer can be set for a short period of between several seconds and about 15–20 seconds. The timing for impregnation can be adjusted based on moisture conditions, temperature conditions and density conditions of the tobacco in the impregnation zone 22. When the timer reaches the set time period, control passes to Block 225 wherein the fill valve is closed. A sensor verifies that this valve is closed and control is immediately passed to Block 230 for rapid opening of the vent valve 62.

Control then passes to Block 235 wherein a pressure sensor within the impregnation zone is repeatedly read until the pressure in the impregnation zone has dropped to a predetermined low pressure, for example, 10–20 psig. At this point, control is passed to Block 240 wherein a valve is opened to allow hydraulic fluid to be removed from seals 40 and 42. An appropriate sensor senses the pressure of the hydraulic fluid in the seals and when the fluid pressure has reached a desirably low pressure, control is passed to Block 245.

In Block 245, the hydraulic piston 28 is activated to move the spool 14 to the unloading position 26. At the same time, the compressor 72 is started for directing high pressure air or nitrogen onto the spool as it is moved into position 26. In Block 250 an appropriate sensor senses the position of the spool when it reaches the fully extended unloading position and the hydraulic piston 28 then immediately changes the direction of motion of the spool for return to the loading position 24. Control is next passed to Block 255 wherein a sensor detects the position of the spool in chamber 12 and the compressor 72 is then deactivated. The control sequence is then started again beginning with Block 200.

The various aspects of the tobacco expansion processes described herein have been discussed specifically in connection with the use of propane as an expansion promoting impregnation agent and the use of impregnation temperature conditions near or above supercritical temperature together with conditions of elevated pressure approaching or above supercritical pressure, and in connection with preferred apparatus. However, various significant tobacco expansion processes and apparatus disclosed herein are also considered applicable to other tobacco expansion processes, expansion fluids, and apparatus. For example, tobacco compression can substantially improve the throughput of many tobacco impregnation processes conducted in various vessels at high pressures of, e.g., above 100 psig, for subsequent tobacco expansion. Similarly, the use of volumes of tobacco expansion agents which are substantially less than the volume of the loose fill volume of the tobacco admitted into the impregnation zone can improve the economics of many tobacco impregnation and expansion processes, including processes where the expansion agent in the impregnation zone is present during impregnation as a gas or liquid or both.

Similarly, substantially instantaneous introduction into the impregnation zone of high temperature, high pressure impregnating fluids, such as carbon dioxide, near or above conditions of both supercritical temperature and pressure, can be used to significantly shorten the impregnation time period necessary prior to a subsequent heating step. Likewise, where the impregnating fluid is employed to impregnate the tobacco under elevated temperature conditions, the tobacco preheating step of this invention can significantly improve the impregnation cycle time.

Tobacco filling capacities when referred to herein, are measured in the normal manner using an electronically automated filling capacity meter in which a solid piston, 3.625 inches in diameter, is slideably positioned in a similarly sized cylinder and exerts a pressure of 2.6 lbs. per sq. in. on a tobacco sample located in the cylinder. These parameters are believed to simulate the packing conditions to which tobacco is subjected in cigarette making apparatus during the formation of a cigarette rod. Measured tobacco samples having a weight of 50 g are used for expanded tobacco. Samples having a weight of 100 g are used for unexpanded tobacco.

The invention has been described in considerable detail with reference to preferred embodiments. However many changes, variations, and modifications can be made without departing from the spirit and scope of the invention as described in the foregoing specification and defined in the appended claims.

That which is claimed:

1. Apparatus for impregnating tobacco with an expansion agent comprising:

a chamber for confining a charge of tobacco under elevated pressure conditions;

means for admitting expansion agent in fluid form into said chamber for impregnating the tobacco; and an accumulator connected to said expansion agent introduction means and being adapted for maintaining a supply of said expansion agent under conditions of elevated temperature and pressure, said accumulator comprising a movable member defining two separate fluid zones wherein one of said zones contains said expansion agent and wherein the other of said zones contains a gaseous pressurizing fluid.

2. The apparatus of claim 1 wherein said movable member is a fluid seal which provides a barrier against the loss of a substantial amount of said expansion fluid from said expansion fluid zone when said expansion fluid is maintained at a pressure above about 2,000 psig and a temperature above about 200° F.

3. The apparatus of claim 1 wherein said pressurizing fluid is nitrogen and said expansion agent is propane.

4. The apparatus of claim 3 wherein said expansion agent is maintained at a pressure above about 2,000 psig and a temperature above about 200° F., and said pressurizing fluid is maintained at a pressure above 6,000 psig.

5. The apparatus of claim 1 wherein said accumulator comprises:

a tubular shell, said movable member being mounted for movement within said shell;

first and second end members mounted at opposing ends of said shell; and first and second shock absorbing members mounted on the inner surface of each of said end members.

6. The apparatus of claim 5 wherein said movable member further comprises:

sealing means positioned about the periphery of said movable member, said sealing means providing sealing contact between the exterior periphery of said movable member and the interior surface of said shell; and lubricating means positioned about the periphery of said movable member, said lubricating means providing lubrication between the exterior periphery of said movable member and the interior surface of said shell.

7. Apparatus for impregnating tobacco with an expansion agent comprising:

a chamber for confining a charge of tobacco under elevated pressure conditions;

means for admitting expansion agent in fluid form into said chamber for impregnating the tobacco; and an accumulator connected to said expansion agent introduction means and being adapted for maintaining a supply of said expansion agent under conditions of elevated temperature and pressure, said accumulator comprising a movable member defining at least one fluid zone having a variable volume, wherein said fluid zone contains said expansion agent.

8. The apparatus of claim 7, wherein said movable member defines at least two separate fluid zones, wherein one of said zones contains said expansion agent and wherein the other of said zones contains a gaseous pressurizing fluid.

9. The apparatus of claim 7 wherein said movable member is a fluid seal which provides a barrier against the loss of a substantial amount of said expansion fluid from said expansion fluid zone when said expansion fluid is maintained at a pressure above about 2,000 psig and a temperature above about 200° F.

10. The apparatus of claim 7 wherein said expansion agent is propane.

11. Apparatus for impregnating tobacco comprising:

chamber means for treating tobacco under conditions of elevated pressure comprising a cylindrical tubular shell, spool means mounted for reciprocal movement between at least a first position outside the shell and a treating position within the shell, said spool means comprising first and second cylindrical end members and a connecting rod extending between and securing said first and second end members together, said end members and said connecting rod defining an annular space around said connecting rod, and sealing means adapted for forming a seal between said cylindrical end members and the inside surface of said shell when said spool means is in the treating position so that said shell, end members and sealing means form a pressure chamber;

means for loading and compressing a charge of tobacco into said chamber;

means for introducing expansion fluid into said chamber for impregnation of said tobacco charge; and means for recovering impregnated compressed tobacco from said expansion chamber.

12. The apparatus of claim 11 wherein said sealing means comprises:

a first inflatable seal member carried on said first end member;

spaced second and third inflatable seal members carried on said second end member; and means for inflating said inflatable seal members.

13. The apparatus of claim 12 wherein said means for inflating said seal members comprises:

grooves on the outer surface of said end members which carry said inflatable end members;

a bore within said connecting rod;

passageways extending between said seal member grooves and said bore; and means for introducing and removing an inflating fluid into said seal member grooves through said bore and said passageways to expand and collapse said inflatable seal members.

14. The apparatus of claim 11 wherein said means for introducing expansion fluid into said chamber comprises port means formed in said shell for introducing said expansion fluid into said chamber when said spool means is in said treating position.

15. The apparatus of claim 14 wherein said port means comprises:

a supply line connected to said tubular shell located at one end of said end member when said spool means is in the treating position;

an annular groove in said end member located on the outer surface thereof;

at least one longitudinal groove extending along the surface of the connecting rod from the inside face of one of said end member to the other; and a passageway extending between the annular groove and said longitudinal groove.

16. The apparatus of claim 15 further comprising a screen assembly carried on said connecting rod, said screen assembly permitting the expansion fluid to pass therethrough under pressure while preventing tobacco being treated from passing into the longitudinal grooves upon removal of the expansion fluid from the pressure vessel.

17. Apparatus for impregnating tobacco comprising:

chamber means comprising spool means for treating tobacco under conditions of elevated pressure;

means for loading and compressing a charge of tobacco into said chamber, said loading and compressing means comprising a pair of opposed conduits on opposing sides of said spool means, and tobacco compressing means mounted for reciprocating movement within each of said conduits between a retracted position and an extended position for moving tobacco through the conduit and compressing the tobacco into said annular space of said spool means;

means for introducing expansion fluid into said chamber for impregnation of said tobacco charge; and means for recovering impregnated compressed tobacco from said expansion chamber.

* * * * *